US009732502B2

(12) United States Patent
Fletcher et al.

(10) Patent No.: US 9,732,502 B2
(45) Date of Patent: Aug. 15, 2017

(54) EXCAVATION SYSTEM PROVIDING IMPACT DETECTION

(71) Applicant: Caterpillar Inc., Peoria, IL (US)

(72) Inventors: Jeffrey Graham Fletcher, Peoria, IL (US); Daniel Aaron Jones, Tasmania (AU); Ricky Kam Ho Chow, Queensland (AU); Ranishka De Silva Hewavisenthi, Queensland (AU)

(73) Assignee: Caterpillar Inc., Peoria, IL (US)

( * ) Notice: Subject to any disclaimer, the term of this patent is extended or adjusted under 35 U.S.C. 154(b) by 35 days.

(21) Appl. No.: 14/790,085

(22) Filed: Jul. 2, 2015

(65) Prior Publication Data

US 2017/0002546 A1 Jan. 5, 2017

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |
| ***E02F 9/26*** | (2006.01) |
| ***E02F 3/34*** | (2006.01) |

(52) U.S. Cl.

CPC ..... *E02F 9/261* (2013.01); *E02F 3/34* (2013.01)

(58) Field of Classification Search

CPC . E02F 9/261; E02F 3/34; G01B 21/22; G01L 3/02

USPC ..... 701/50

See application file for complete search history.

(56) References Cited

U.S. PATENT DOCUMENTS

| | | | | |
|---|---|---|---|---|
| 5,065,326 | A | 11/1991 | Sahm | |
| 5,293,944 | A | 3/1994 | Matsumoto | |
| 5,535,532 | A | 7/1996 | Fujii et al. | |
| 5,617,724 | A | 4/1997 | Ko | |
| 5,960,378 | A | 9/1999 | Watanabe et al. | |
| 5,968,103 | A * | 10/1999 | Rocke | E02F 3/432 172/4.5 |
| 5,974,352 | A | 10/1999 | Shull | |
| 5,986,750 | A * | 11/1999 | Sasabe | G01B 11/26 222/437 |
| 6,205,687 | B1 | 3/2001 | Rocke | |
| 6,321,153 | B1 | 11/2001 | Rocke et al. | |
| 6,363,632 | B1 | 4/2002 | Stentz et al. | |
| 6,615,114 | B1 | 9/2003 | Skiba et al. | |

(Continued)

FOREIGN PATENT DOCUMENTS

| | | |
|---|---|---|
| CN | 103292715 | 9/2013 |
| WO | WO 2010/074003 A1 | 7/2010 |

OTHER PUBLICATIONS

"Wikipedia: Angle of Repose" https://web.archive.org/web/20140810030005/http://en.wikipedia.org/wiki/Angle_of_repose.*

(Continued)

*Primary Examiner* — Calvin Cheung
*Assistant Examiner* — Paula L Schneider
(74) *Attorney, Agent, or Firm* — Finnegan, Henderson, Farabow, Garrett & Dunner, LLP

(57) ABSTRACT

An excavation system is disclosed for use with a mobile machine having a work tool. The excavation system may have a first sensor configured to generate a first signal indicative of a distance to an inclined face of the pile of material, and a controller in communication with the first sensor. The controller may be configured to determine a repose angle of the pile of material based on a known edge location of the pile of material and the distance.

19 Claims, 3 Drawing Sheets

(56) References Cited

U.S. PATENT DOCUMENTS

| | | | |
|---|---|---|---|
| 6,879,899 | B2 | 4/2005 | Budde |
| 7,555,855 | B2 | 7/2009 | Alshaer et al. |
| 7,640,683 | B2 | 1/2010 | McCain |
| 7,658,234 | B2 | 2/2010 | Brandt et al. |
| 7,797,934 | B2 | 9/2010 | Bacon et al. |
| 7,853,382 | B2 | 12/2010 | Anderson |
| 7,865,285 | B2 | 1/2011 | Price et al. |
| 8,042,290 | B2 | 10/2011 | Hartwick |
| 8,145,394 | B2 | 3/2012 | Chiorean et al. |
| 8,160,783 | B2 | 4/2012 | Shull |
| 8,280,596 | B2 | 10/2012 | Hagenbuch |
| 8,363,210 | B2 | 1/2013 | Montgomery |
| 8,478,492 | B2 | 7/2013 | Taylor et al. |
| 8,527,155 | B2 | 9/2013 | Gudat |
| 8,654,608 | B2 | 2/2014 | Lindskov |
| 8,726,647 | B2 | 5/2014 | Peterson et al. |
| 8,813,486 | B2 | 8/2014 | Peterson et al. |
| 8,838,329 | B2 | 9/2014 | Seki |
| 8,874,265 | B2 | 10/2014 | Rakshit |
| 8,886,493 | B2 | 11/2014 | Taylor |
| 8,903,689 | B2 | 12/2014 | Dunbabin et al. |
| 2012/0055051 | A1 | 3/2012 | Polston et al. |
| 2013/0158789 | A1 | 6/2013 | Seki |
| 2014/0277957 | A1 | 9/2014 | Clar et al. |

OTHER PUBLICATIONS

U.S. Patent Application entitled "Excavation System Providing Automated Tool Linkage Calibration" filed Jul. 2, 2015 by Jeffrey Graham Fletcher et al.

U.S. Patent Application entitled "Excavation System Providing Impact Detection" filed Jul. 2, 2015 by Jeffrey Graham Fletcher et al.

U.S. Patent Application entitled "Excavation System Providing Automated Stall Correction" filed Jul. 2, 2015 by Jeffrey Graham Fletcher et al.

U.S. Application entitled "Excavation System Having Adaptive Dig Control" filed Jul. 2, 2015 by Jeffrey Graham Fletcher et al.

U.S. Application entitled "Excavation System Having Velocity Based Work Tool Shake" filed Jul. 2, 2015 by Jeffrey Graham Fletcher et al.

* cited by examiner

EXCAVATION SYSTEM PROVIDING IMPACT DETECTION

TECHNICAL FIELD

The present disclosure is directed to an excavation system and, more particularly, to an excavation system providing detection of impact between a machine and a material pile.

BACKGROUND

Heavy equipment, such as load-haul-dump machines (LHDs), wheel loaders, carry dozers, etc., are used during an excavation process to scoop up loose material from a pile at a first location (e.g., within a mine tunnel), to haul the material to a second location (e.g., to a crusher), and to dump the material. A productivity of the excavation process can be affected by an efficiency of each machine during every excavation cycle. In particular, the efficiency of each machine increases when the machine's tool (e.g., a bucket) is fully loaded with material at the pile within a short amount of time, hauled via a direct path to the second location, and quickly dumped.

Some applications require operation of the heavy equipment under hazardous working conditions. In these applications, some or all of the machines can be remotely or autonomously controlled to complete the excavation process. When a machine is remotely or autonomously controlled, however, situational awareness may be limited. That is, it can be difficult for the remote operator or the automated system to accurately determine a degree of tool engagement with the pile during the loading segment of the excavation process. As a result, the machine's tool may be underloaded during a particular loading segment, or too much energy and time may be consumed by attempting to increase loading of the tool.

One attempt to improve efficiency in the loading segment of the excavation process is disclosed in U.S. Pat. No. 8,363,210 of Montgomery that issued on Jan. 29, 2013 ("the '210 patent"). Specifically, the '210 patent discloses a system for locating a topographic feature at a job-site. The system includes a laser range finder connected to the arm of an excavator, and a computer in communication with the laser range finder. The laser range finder directs a pattern of light onto the topographic feature, and the computer is configured to receive a reflection of the light, thereby locating a point on the feature. By directing the light onto multiple different points of the feature, the computer may, through the use of common equations, be able to determine a location, angle, slope, grade, and volume of the feature.

Although the system of the '210 patent may provide information that could possibly improve machine efficiencies, the system may still be less than optimal. In particular, the system may require the excavator to be stationary; the location of the excavator may need to be precisely known; movements of the excavator may need to accurately tracked; and the light may need to be manually and perfectly aimed. In addition, in order to determine feature parameters other than a single point location, the system may have to separately detect the locations of multiple different points so that the corresponding calculations can be performed. These actions may take a significant amount of time, and also allow for the introduction of error.

The disclosed excavation system is directed to overcoming one or more of the problems set forth above and/or other problems of the prior art.

SUMMARY

One aspect of the present disclosure is directed to an excavation system for a mobile machine having a work tool. The excavation system may include at least a first sensor configured to generate a first signal indicative of a distance to an inclined face of the pile of material, and a controller in communication with the first sensor. The controller may be configured to determine a repose angle of the pile of material based on a known edge location of the pile of material and the distance.

Another aspect of the present disclosure is directed to a method of controlling a mobile machine having a work tool. The method may include sensing at least a first parameter indicative of engagement of the work tool with a pile of material, and scanning an inclined face of the pile of material to determine a distance to the inclined face. The method may further include determining an edge location of the pile of material based on the at least a first parameter, and determining a repose angle of the pile of material based on the edge location and the distance.

Another aspect of the present disclosure is directed to a mobile machine. The mobile machine may include a frame; a plurality of wheels rotatably connected to the frame and configured to support the frame; a powertrain mounted to the frame and configured to drive the plurality of wheels; and a work tool operatively connected to the frame and having a tip configured to engage a material to be moved by the mobile machine. The mobile machine may further include at least a first sensor configured to generate a first signal indicative of engagement of the work tool with a pile of material, and a second sensor located a known elevation above a ground surface under the mobile machine and configured to generate a second signal indicative of a horizontal distance to an inclined face of the pile of material. The mobile machine may also include a controller in communication with the at least a first sensor and the second sensor. The controller may be configured to determine an edge location of the pile of material based on the first signal, and to translate the horizontal distance to the edge location. The controller may be further configured to determine a repose angle of the pile of material based on the translated horizontal distance and the elevation as an arc-tangent function.

DETAILED DESCRIPTION

Figure 1:
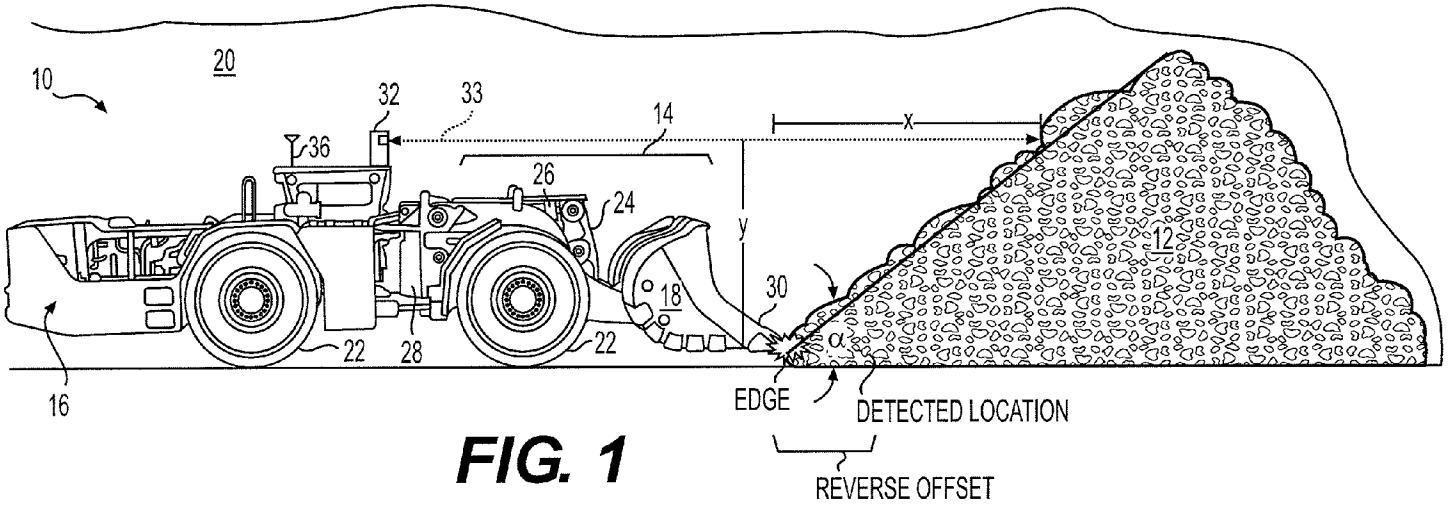
FIGS. 1 and 2 are side and top-view diagrammatic illustrations, respectively, of an exemplary disclosed mobile machine operating at a worksite.
Figure 2:
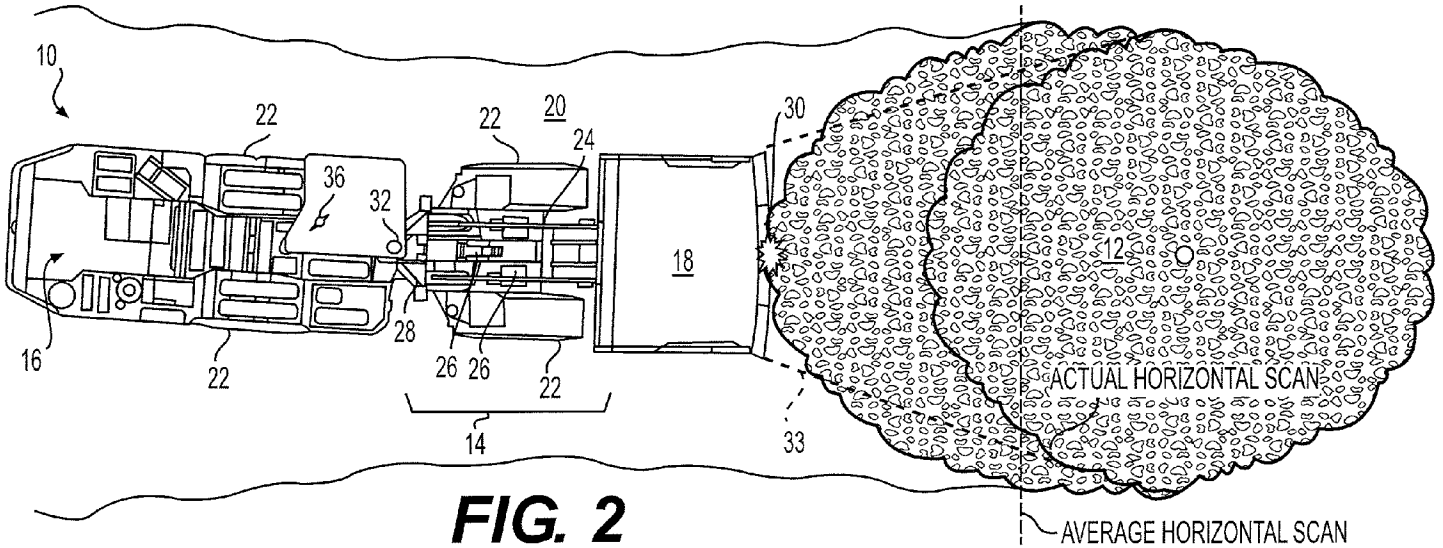

FIGS. 1 and 2 illustrate an exemplary mobile machine 10 having multiple systems and components that cooperate to move material 12. In the disclosed example, machine 10 is a load-haul-dump machine (LHD). It is contemplated, however, that machine 10 could embody another type of excavation machine (e.g., a wheel loader or a carry dozer), if desired.

Machine 10 may include, among other things, an implement system 14 and a powertrain 16. Implement system 14 may be driven by powertrain 16 to repetitively move a work tool 18 during completion of an excavation cycle. The disclosed excavation cycle is associated with removing a pile of material 12 from inside of a mine tunnel 20. Powertrain 16, in addition to driving implement system 14, may also function to propel machine 10, for example via one or more traction devices (e.g., wheels or tracks) 22.

The disclosed implement system 14 includes a linkage structure 24 that cooperates with one or more hydraulic actuators 26 to move work tool 18. Linkage structure 24 may be pivotally connected at a first end to a frame 28 of machine 10, and pivotally connected at a second end to work tool 18. In the disclosed embodiment, hydraulic actuators 26 include a single tilt cylinder and a pair of lift cylinders connected between work tool 18, linkage structure 24, and/or frame 28 to dump/rack (i.e., tilt) and raise/lower (i.e., lift) work tool 18, respectively. It is contemplated, however, that a greater or lesser number of hydraulic actuators 26 may be included within implement system 14 and/or connected in a manner other than described above, if desired.

Powertrain 16 may be supported by frame 28, and include an engine configured to produce a rotational power output and a transmission that converts the power output to a desired ratio of speed and torque. The rotational power output may be used to drive a pump that supplies pressurized fluid to hydraulic actuators 26 and/or to one or more motors (not shown) associated with wheels 22. The engine of powertrain 16 may be a combustion engine configured to burn a mixture of fuel and air, the amount and/or composition of which directly corresponds to the rotational power output. The transmission of powertrain 16 may take any form known in the art, for example a power shift configuration that provides multiple discrete operating ranges, a continuously variable configuration, or a hybrid configuration.

Numerous different work tools 18 may be operatively attachable to a single machine 10 and driven by powertrain 16 (e.g., by the engine of powertrain 16). Work tool 18 may include any device used to perform a particular task such as, for example, a bucket, a fork arrangement, a blade, a shovel, or any other task-performing device known in the art. Although connected in the embodiment of FIG. 1 to lift and tilt relative to machine 10, work tool 18 may alternatively or additionally rotate, slide, swing open/close, or move in any other manner known in the art. In the disclosed embodiment, work tool 18 is a bucket having a tip 30 configured to penetrate the pile of material 12.

Machine 10 may also include one or more externally mounted sensors 32. Each sensor 32 may be a device that detects and ranges objects, for example a LIDAR (light detection and ranging) device, a RADAR (radio detection and ranging) device, a SONAR (sound navigation and ranging) device, a camera device, or another device known in the art. In one example, sensor 32 may include an emitter that emits a horizontal 2-D detection beam 33 within a zone located in front of machine 10 (i.e., in front of work tool 18), and an associated receiver that receives a reflection of that detection beam. Based on characteristics of the reflected beam, a distance and a direction from an actual sensing location of sensor 32 on machine 10 to a portion of the sensed object (e.g., to a conical pile face of material 12) within the particular zone may be determined. Sensor 32 may then generate a signal corresponding to the distance, direction, size, and/or shape of the object at the height of sensor 32, and communicate the signal to an onboard controller 34 (shown only in FIG. 3) for subsequent conditioning.

Alternatively or additionally, machine 10 may be outfitted with a communication device 36 that allows communication of the sensed information to an offboard entity. For example, excavation machine 10 may communicate with a remote control operator and/or a central facility (not shown) via communication device 36. This communication may include, among other things, the location of material 12, properties (e.g., shape) of the material pile, operational parameters of machine 10, and/or control instructions or feedback.

Figure 3:
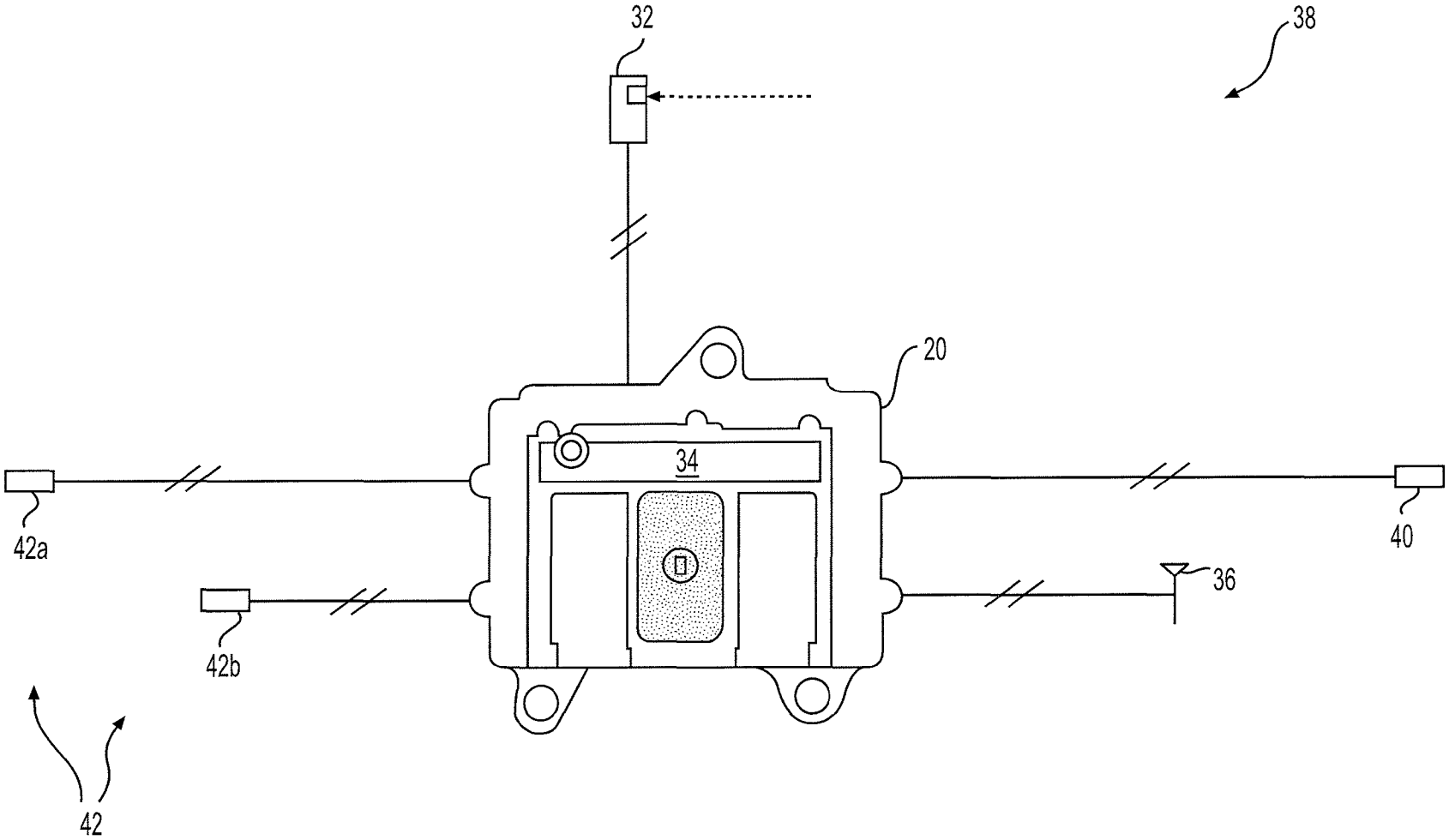
FIG. 3 is a diagrammatic illustration of an exemplary disclosed excavation system that may be used in conjunction with the mobile machine of FIGS. 1 and 2.

FIG. 3 illustrates an excavation system 38 that is configured to automatically detect the location and/or shape (e.g., repose angle $\alpha$) of the pile of material 12 (referring to FIGS. 1 and 2). Excavation system 38 may include, among other things, sensor 32, controller 34, communication device 36, a travel speed sensor 40, and at least one load sensor 42. Controller 34 may be in communication with each of the other components of excavation system 38 and, as will be explained in more detail below, configured to detect engagement of work tool 18 (referring to FIGS. 1 and 2) with material 12, to determine an outer edge location of material 12 at a floor of tunnel 20, and to calculate the repose angle $\alpha$ of material 12. This information may then be used for remotely or autonomously controlling machine 10, among other things.

Controller 34 may embody a single microprocessor or multiple microprocessors that include a means for monitoring operations of excavation machine 10, communicating with an offboard entity, and detecting properties of material 12. For example, controller 34 may include a memory, a secondary storage device, a clock, and a processor, such as a central processing unit or any other means for accomplishing a task consistent with the present disclosure. Numerous commercially available microprocessors can be configured to perform the functions of controller 34. It should be appreciated that controller 34 could readily embody a general machine controller capable of controlling numerous other machine functions. Various other known circuits may be associated with controller 34, including signal-conditioning circuitry, communication circuitry, and other appropriate circuitry.

Communication device 36 may include hardware and/or software that enable the sending and/or receiving of data messages through a communications link. The communications link may include satellite, cellular, infrared, radio, and any other type of wireless communications. Alternatively, the communications link may include electrical, optical, or any other type of wired communications, if desired. In one embodiment, onboard controller 34 may be omitted, and an offboard controller (not shown) may communicate directly with sensor 32, sensor 40, sensor(s) 42, and/or other components of machine 10 via communication device 36, if desired.

Travel speed sensor 40 may embody a conventional rotational speed detector having a stationary element rigidly connected to frame 28 (referring to FIGS. 1 and 2) that is configured to sense a relative rotational movement of wheel 22 (e.g., of a rotating portion of powertrain 16 that is operatively connected to wheel 22, such as an axle, a gear, a cam, a hub, a final drive, etc.). In the depicted example, the stationary element is a magnetic or optical element mounted to an axle housing (e.g., to an internal surface of the housing) and configured to detect the rotation of an indexing element (e.g., a toothed tone wheel, an imbedded magnet, a calibration stripe, teeth of a timing gear, a cam lobe, etc.) connected to rotate with one or more of wheels 22. In this example, the indexing element could be connected to, embedded within, or otherwise form a portion of the front axle assembly that is driven to rotate by powertrain 16. Sensor 40 may be located adjacent the indexing element and configured to generate a signal each time the indexing element (or a portion thereof, for example a tooth) passes near the stationary element. This signal may be directed to controller 34, and controller 34 may use this signal to determine a distance travelled by machine 10 between signal generation times (i.e., to determine a travel speed of machine 10). Controller 34 may record the traveled distances and/or speed values associated with the signal within an array during forward travel of machine 10 toward material 12, and correlate the signals to time intervals between signal receipt. That is, the array may be a time-based array of speed and/or distance signals, such that at a time $T_1$, the array may store a corresponding speed $S_1$ and/or distance $D_1$; at time $T_2$, the array may store a corresponding speed $S_2$ and/or distance $D_2$; at a time $T_3$, the array may store a corresponding speed $S_3$ and/or distance $D_3$; etc. Alternatively or additionally, controller 34 may simply record a number of wheel rotations that have occurred within fixed time intervals, and then later use this information along with known kinematics of wheel 22 to determine the distance and speed values. Other types of sensors and/or strategies may also or alternatively be employed.

Load sensor 42 may be any type of sensor known in the art that is capable of generating a load signal indicative of a loading status of work tool 18. For the purposes of this disclosure, the loading status of work tool 18 may not necessarily be associated with an amount of material inside of work tool 18, as is common in the art. Instead, the loading status of work tool 18 may be associated with an amount of force passing through work tool 18, such as when work tool 18 is being pushed into or against the pile of material 12. For example, load sensor 42 may be a torque sensor 42*a* associated with powertrain 16, or an accelerometer 42*b*. When load sensor 42 is embodied as a torque sensor 42*a*, the load signal may correspond with a change in torque output experienced by powertrain 16 during travel of machine 10. In one embodiment, the torque sensor is physically associated with the transmission or final drive of powertrain 16. In another embodiment, the torque sensor is physically associated with the engine of powertrain 16. In yet another embodiment, the torque sensor is a virtual sensor used to calculate the torque output of powertrain 16 based on one or more other sensed parameters (e.g., fueling of the engine, speed of the engine, and/or the drive ratio of the transmission or final drive). Accelerometer 42*b* may embody a conventional acceleration detector rigidly connected to frame 28 in an orientation that allows sensing of fore/aft changes in acceleration of machine 10. It is contemplated that excavation system 38 may include any number and combination of load sensors 42.

Figure 4:
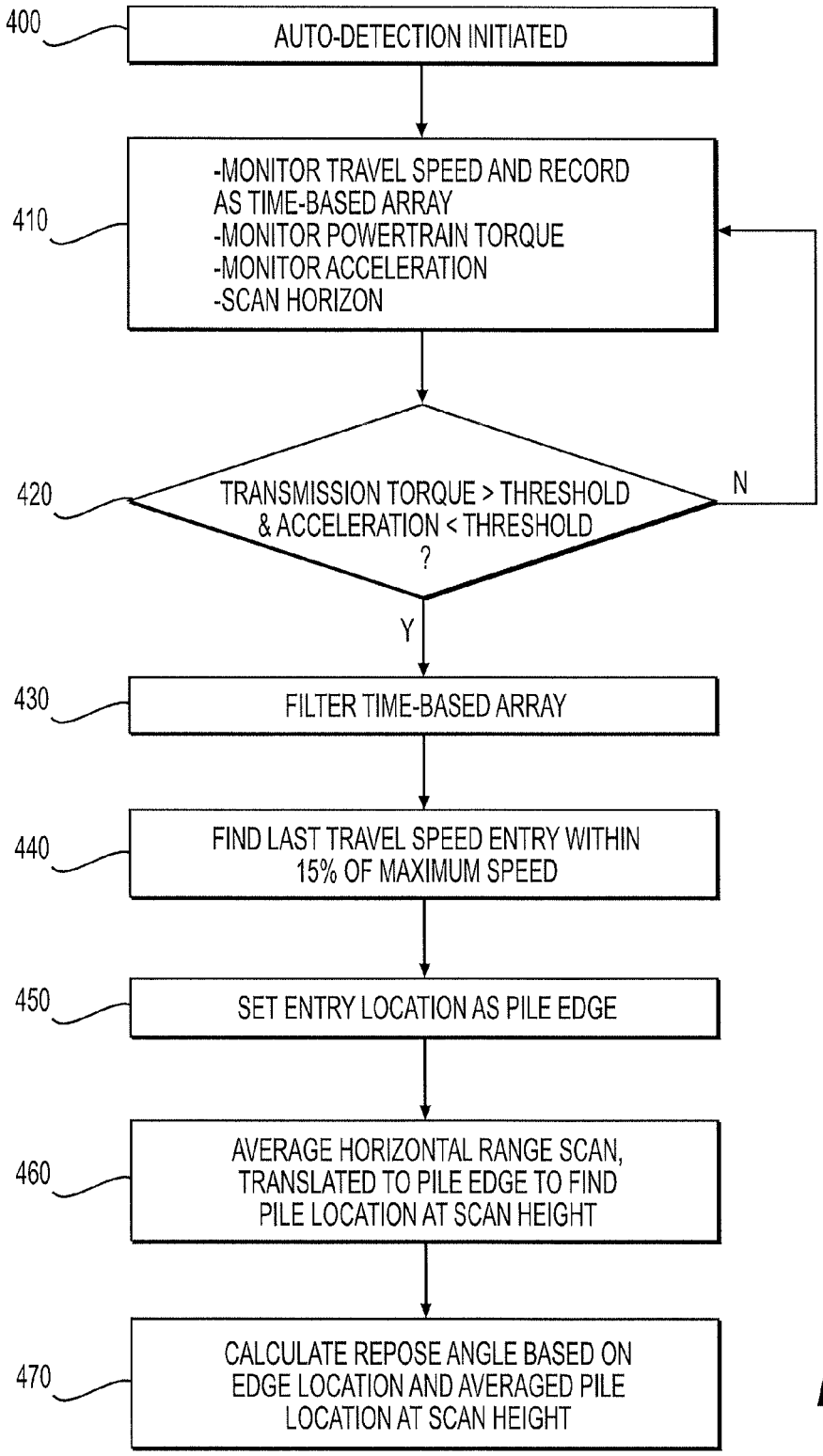
FIG. 4 is a flowchart depicting an exemplary disclosed method that may be performed by the excavation system of FIG. 3.

FIG. 4 illustrates an exemplary method that may be performed by excavation system 38. FIG. 4 will be discussed in more detail in the following section to further illustrate the disclosed concepts.

INDUSTRIAL APPLICABILITY

The disclosed excavation system finds potential application within any mobile machine at any worksite where it is desirable to provide tool loading assistance and/or automated control. The excavation system finds particular application within an LHD, wheel loader, or carry dozer that operate under hazardous conditions. The excavation system may assist control of the machine by automatically detecting tool engagement with a pile of material, and responsively determining a location and shape of the pile. This information may then be used for a variety of purposes including, among other things, remote and autonomous control of the work tool and/or machine. Operation of excavation system 38 will now be described in detail with reference to FIG. 4.

Excavation system 38 may be activated at any time during forward travel of machine 10 to automatically detect engagement of work tool 18 with the pile of material 12. The auto-detection functionality may be initiated by controller 34 (Step 400) in response to a variety of input. For example, controller 34 may automatically initiate auto-detection in response to a detection of forward travel (e.g., in response to a signal from speed sensor 40). In another example, auto-detection may be initiated in response to a proximity to material 12 (e.g., in response to a signal from sensor 32). In yet another example, auto-detection may be initiated manually by a local or remote operator. Any combination of these inputs (and others) may be utilized to initiate auto-detection, as desired.

Once auto-detection of material 12 has been initiated, controller 34 may continuously monitor the travel speed of machine 10 and populate the time-based array with recorded values, monitor powertrain torque, monitor machine acceleration, and/or scan the horizon in front of machine 10 (Step 410). As described above, the travel speed may be monitored via sensor 40, the powertrain torque may be monitored via load sensor 42*a*, the machine acceleration may be monitored via accelerometer 42*b*, and the horizon may be scanned via sensor 32.

During forward travel of machine 10, when tip 30 of work tool 18 engages material 12, the speed of machine 10 will immediately begin to slow down. This slowing down may be observed by a sharp change in velocity and/or acceleration (i.e., by an increase in negative velocity or acceleration). In addition, because of the forward momentum of powertrain 16 and the increasing resistance of the material in the pile, the slowing down of machine 10 may be further observed by a sharp change in torque output of powertrain 16 (i.e., by an increase in torque output). Accordingly, controller 34 may continuously compare monitored values of torque output and/or velocity and acceleration to respective threshold values to detect the engagement of work tool 18 with material 12 (Step 420). As long as at least one of the torque output and velocity or acceleration values remains below the corresponding threshold value, control may cycle back to step 410.

However, if at step 410 both of the torque output and the velocity or acceleration values exceed the respective threshold values, controller 34 may conclude that work tool 18 has engaged the pile of material 12. At this point in time, however, controller 34 may not know how deeply tip 30 has penetrated the material pile. If remote or autonomous control were to commence based solely on the engagement knowledge, the control could be inefficient. Accordingly, controller 34 may attempt to learn more about the pile of material 12 prior to implementing a control strategy.

After detecting that work tool 18 has engaged material 12, controller 34 may filter the array of pre-recorded speed signals to determine at what location tip 30 first came into contact with a pile edge of material 12 (Step 430). That is, controller 34 may compare the different speed entries previously recorded within the time-based array to determine a maximum travel speed attained during the approach to material 12, as well as a last speed entry recorded that was within a threshold amount of about 10-20% (e.g., about 15%) of the maximum value (Step 440). The maximum value may correspond with a time confidently before work tool 18 first contacted the pile of material 12, after which the travel speed of machine 10 began to slow down. The last speed entry recorded that was with about 10-20% of the maximum value may correspond with a time confidently after, but still near the first pile contact. Controller 34 may then correlate this last speed entry with a reverse offset distance away from the location of engagement detection (i.e., with a distance traveled or a number of wheel rotations that occurred between a deceleration start point and the point of engagement detection—shown in FIG. 1), and set the newly established location as the edge of the material pile (Step 450).

In some applications, knowing the edge location of the pile of material 12 may be sufficient for remote or autonomous control over machine 10 and work tool 18. However, in other applications, the repose angle α of material 12 may also be important. For example, the repose angle α may provide insight as to how material 12 may spill into work tool 18 when work tool 18 is lifted and/or tilted from its detected engagement location.

Accordingly, after completion of step 450, controller 34 may be configured to average the values obtained from sensor 32 (i.e., to average a range of the horizontal scan—see FIG. 2), and to translate the averaged range to the newly established edge of the material pile (Step 460). In particular, the pile of material 12 may not have a flat vertical face that is located at a common distance away from sensor 32. Instead, material 12 may generally pile in the shape of a cone (see FIGS. 1 and 2). Thus, during scanning of material 12, the material 12 located at a center of the cone-shaped pile may be closer to sensor 32 than material 12 located at outward (i.e., left and right—when viewed from an operator's perspective) edges of the pile. Sensor 32 may generate a horizontal scan having a width about the same as a width of work tool 18 that is generally centered with work tool 18. This horizontal scan may have corresponding distance values that decrease from opposing edges toward the center. Controller 34 may be configured to average these distance values to determine an average distance (represented by dashed line in FIG. 2) from sensor 32 to material 12 at a known elevation of sensor 32 (represented by y in FIG. 1). This horizontal scan and average may be generated after machine 10 has stopped moving, when tip 30 is positioned at the detected engagement location. In order to accurately determine the repose angle α of the material pile, controller 34 may need to translate the averaged horizontal scan range from the location of sensor 32 on machine 10 to the location of the edge of the pile. That is, controller 34 may substract the reverse offset distance and a distance from sensor 32 to tip 30 from the averaged horizontal range in order to determine a true distance (represented by x in FIG. 1) that the average horizontal scan range is away from the edge of the pile.

Controller 34 may then determine the repose angle α (Step 470). Knowing the vertical elevation y of sensor 32 away from a ground surface of tunnel 20 (referring to FIG. 1) and the horizontal distance x between the edge of the material pile and the average of the horizontal scan range (i.e., the distance from sensor 32 to the inclined face of the pile), controller 34 may determine the repose angle α as an arc-tangent function of the vertical distance y divided by the horizontal distance x (i.e., $\alpha = \arctan y/x$).

As described above, the repose angle α, along with the location of the edge of the pile of material, may be helpful in controlling machine 10. For example, these different pieces of information may provide insight about how to position and move tool 18 at different times during the forward movement of machine 10 to fill tool 18 with the most amount of material in the shortest time possible.

It will be apparent to those skilled in the art that various modifications and variations can be made to the excavation system of the present disclosure. Other embodiments will be apparent to those skilled in the art from consideration of the specification and practice of the excavation system disclosed herein. It is intended that the specification and examples be considered as exemplary only, with a true scope being indicated by the following claims and their equivalents.

What is claimed is:

1. An excavation system for a mobile machine having a work tool, comprising:

a first sensor configured to generate a first signal indicative of a distance from a first sensor location on the mobile machine to an inclined face of a pile of material;

a second sensor configured to generate a second signal indicative of engagement of the work tool with the pile of material; and a controller in communication with the first sensor and the second sensor, and configured to:

determine an edge location of the pile of material based on the second signal; and determine a repose angle of the pile of material based on the edge location of the pile of material and the distance from the first sensor location on the mobile machine to the inclined face of the pile of material at a time of second signal generation.

2. The excavation system of claim 1, wherein:

the distance is a horizontal distance;

the first sensor is located a known elevation above a ground surface under the mobile machine; and the controller is configured to determine the repose angle based on the horizontal distance and the known elevation.

3. The excavation system of claim 2, wherein the controller is further configured to:

translate the horizontal distance to the edge location; and determine the repose angle based on the translated horizontal distance and the known elevation.

4. The excavation system of claim 3, wherein the controller is configured to determine the repose angle as an arc-tangent function.

5. The excavation system of claim 1, wherein the at least a second sensor includes:

a torque sensor; and an acceleration sensor.

6. The excavation system of claim 1, wherein the first sensor includes:

an emitter configured to generate a beam directed against the inclined face; and a receiver configured to receive a reflection of the beam.

7. The excavation system of claim 6, wherein the beam is a 2-D beam that is oriented horizontally.

8. The excavation system of claim 7, wherein the controller is configured to:

generate an average of scanned horizontal distances to the inclined face as measured by the scanning sensor; and determine the repose angle based on the average.

9. The excavation system of claim 7, wherein the beam has a width about the same as a width of the work tool, and is centered with the work tool.

10. A method of controlling a mobile machine having a work tool, comprising:

sensing, with a first sensor, at least a first parameter indicative of engagement of the work tool with a pile of material;

scanning, with a second sensor, an inclined face of the pile of material to determine a distance to the inclined face at a time of the engagement of the work tool with the pile of material;

determining, by a controller in communication with the first sensor and the second sensor, an edge location of the pile of material based on the at least first parameter; and determining, by the controller, a repose angle of the pile of material based on the edge location and the distance.

11. The method of claim 10, wherein the distance is a horizontal distance from the edge location to the inclined face.

12. The method of claim 11, wherein determining the repose angle of the pile of material includes determining the repose angle based further on the known elevation.

13. The method of claim 12, wherein determining the repose angle of the pile of material includes determining the repose angle as an arc-tangent function.

14. The method of claim 10, wherein scanning the inclined face includes:

emitting a beam directed against the inclined face; and receiving a reflection of the beam.

15. The method of claim 14, wherein the beam is a 2-D beam that is oriented horizontally.

16. The method of claim 15, further including generating an average of scanned horizontal distances to the inclined face, wherein determining the repose angle of the pile of material includes determining the repose angle based on the average.

17. The method of claim 14, wherein the beam has a width about the same as a width of the work tool, and is centered with the work tool.

18. The method of claim 14, wherein sensing the at least a first parameter includes:

sensing a torque of the mobile machine; and sensing an acceleration of the mobile machine.

19. A mobile machine, comprising:

a frame;

a plurality of wheels rotatably connected to the frame and configured to support the frame;

a powertrain mounted to the frame and configured to drive the plurality of wheels;

a work tool operatively connected to the frame and having a tip configured to engage a material to be moved by the mobile machine;

at least a first sensor configured to generate a first signal indicative of engagement of the work tool with a pile of material;

a second sensor located at a second sensor location on the mobile machine that is a known elevation above a ground surface under the mobile machine and configured to generate a second signal indicative of a horizontal distance from the second sensor location to an inclined face of the pile of material; and a controller in communication with the at least a first sensor and the second sensor, the controller being configured to:

determine an edge location of the pile of material based on the first signal;

translate the horizontal distance sensed at a time of first signal generation to the edge location; and determine a repose angle of the pile of material based on the translated horizontal distance and the known elevation as an arc-tangent function.

* * * * *